United States Patent [19]

Gentry

[11] Patent Number: 4,506,728

[45] Date of Patent: Mar. 26, 1985

[54] APPARATUS FOR VARYING SHELL FLUID FLOW IN SHELL AND TUBE HEAT EXCHANGER

[75] Inventor: Cecil C. Gentry, Bartlesville, Okla.

[73] Assignee: Phillips Petroleum Company, Bartlesville, Okla.

[21] Appl. No.: 395,450

[22] Filed: Jul. 6, 1982

[51] Int. Cl.[3] ..... F28F 27/00

[52] U.S. Cl. ..... 165/96; 165/159

[58] Field of Search ..... 165/96, 159, 160, 161, 165/110, 137

[56] References Cited

U.S. PATENT DOCUMENTS

| | | | |
|---|---|---|---|
| 1,548,390 | 8/1925 | Schloe | 165/96 X |
| 1,934,496 | 11/1933 | Glisson | 165/160 |
| 1,960,770 | 5/1934 | Brown | 165/161 |
| 2,310,234 | 2/1943 | Haug | 165/160 |
| 2,753,954 | 7/1956 | Tinker | 165/159 |
| 2,916,264 | 12/1959 | Rhodes | 165/161 |
| 2,919,903 | 1/1960 | Vautrain et al. | 165/161 |
| 2,942,855 | 6/1960 | Wellensiek | 165/159 |
| 3,048,373 | 8/1962 | Bauer et al. | 165/161 |
| 3,351,131 | 11/1967 | Berthold | 165/159 |
| 3,884,297 | 5/1975 | Fegraus et al. | 165/158 X |
| 4,127,165 | 11/1978 | Small | 165/162 |
| 4,127,389 | 11/1978 | Hackemesser et al. | 165/159 X |

FOREIGN PATENT DOCUMENTS

| | | | |
|---|---|---|---|
| 512357 | 6/1976 | U.S.S.R. | 165/96 |
| 737771 | 6/1980 | U.S.S.R. | 165/159 |

*Primary Examiner*—Allen M. Ostrager

*Attorney, Agent, or Firm*—French & Doescher

[57] ABSTRACT

A shell unit, for use in a shell and tube heat exchanger, includes a shell having shell ports whose flow areas are adjustable. The unit comprises an annular distributor having an annulus which surrounds the shell such that fluid may flow from the annulus into the shell ports, and a nozzle in fluid communication with the annulus for feeding shell fluid into the annulus. A means is provided in the shell unit for adjusting the fluid flow area of the ports. In one embodiment, the means for adjusting the flow area is an insert rotatably mounted within the shell which may be rotated to at least partially cover the ports a selected amount.

18 Claims, 14 Drawing Figures

APPARATUS FOR VARYING SHELL FLUID FLOW IN SHELL AND TUBE HEAT EXCHANGER

BACKGROUND OF THE INVENTION

In one aspect, this invention relates to an improved shell and tube heat exchanger. In another aspect, the invention relates to apparatus and methods for reducing the pressure drop in the flow of shell side fluid in a shell and tube heat exchanger.

Heat transfer is an important part of any process. As is well known, an indirect transfer of heat from one medium to another is usually accomplished by the use of heat exchangers, of which there are many types. For example, there are double pipe, shell and tube, plate heat exchangers and others. Indeed, the art of heat exchanger design is developed to a very high degree; however, there is still room for improvement in a number of areas, such as reducing pressure drop, increasing overall heat transfer coefficients, reducing fouling and in heat exchangers utilizing a tube bundle, such as the shell and tube heat exchangers, in improving the flow of the medium through the shell in contact with the tube bundle. In shell-and-tube heat exchanger designs, it is frequently advantageous to utilize "vapor belts" or annular distributors to reduce shellside inlet and exit pressure losses, reduce impingement velocities, and improve shellside fluid distribution. In *Standards of Tubular Exchanger Manufacturers Association,* 6th Edition, 1978, the following shell side impingement protection requirements are set forth in Section 5, page 29:

> "An impingement plate, or other means to protect the tube bundle against impinging fluids, shall be provided when entrance line values of $\rho v^2$ exceed the following: non-corrosive, nonabrasive, single-phase fluids 1500; all other liquids, including a liquid at its boiling point, 500. For all other gases and vapors, including all nominally saturated vapors, and for liquid vapor mixtures, impingement protection is required. $v$ is the linear velocity of the fluid in feet per second and $\rho$ is its density in pounds per cubic foot. A properly designed diffuser may be used to reduce line velocities at shell entrance."

An annular distributor is conventionally designed such that the ratios of nozzle-to-annulus flow area and annulus-to-slot flow area provide a recovery of static pressure by virtue of reduced momentum with passage through the nozzle, annulus, and shell slots. The exact magnitudes of these area ratios required to fulfil this criterion are not precisely predictable. If these area ratios are incorrectly specified by the designer, the pressure recovery through the annular distributor may be less than optimal and possibly result in a negative pressure recovery (i.e., positive pressure loss). It is thus desirable to provide apparatus and methods for adjusting such flow areas in tube and shell heat exchangers fitted with annular distributors, so that pressure drop can be minimized, particularly in the areas between nozzles and the shell interior, and flow through the shell and over the tube bundle optimized.

SUMMARY OF THE INVENTION

It is an object of this invention to provide a shell suitable for use in a shell and tube heat exchanger, utilizing at least one shell side annular distributor, characterized by low shell side pressure drop, especially in the regions between the nozzles and the shell interior. It is a further object of this invention to provide means for adjusting the nozzle and shell slot or port flow areas, so that the flow area ratios of nozzle to annulus and annulus to shell ports can be optimized and pressure drop across the shell unit can be minimized. Another object of this invention is to provide means for adjusting the circumferential and radial distribution of fluid passing from an annular distributor into such a shell so that, e.g., a tube sheet installed within the shell would receive uniform distribution of the fluid entering the shell, such that the heat transfer process is optimized. A still further object of this invention is to provide a complete shell-and-tube heat exchanger with means for adjusting the nozzle and shell port flow areas, and/or adjusting the radial distribution of fluid entering the shell, so that the flow area ratios of nozzle to annulus and annulus to shell ports can be optimized (and thus pressure drop across the shell unit minimized) and the heat transfer process optimized.

These and other objects, advantages, details, features and embodiments of this invention will become apparent to those skilled in the art from the following description of the invention, the drawing, and the appended claims.

According to the present invention, a shell suitable for use in a shell-and-tube heat exchanger is provided, having an inner surface and at least one annular distributor attached to said shell, with at least one nozzle means in communication with the annulus of said annular distributor, at least one shell port which provides communication for said annulus with said inner surface of said shell, and means for adjusting the fluid flow area of at least one nozzle and/or at least one shell port.

Further according to the present invention, in a shell and tube heat exchanger comprising a tube bundle enclosed within a shell having a first end and a second end, wherein the shell is provided with a first nozzle near the first end for the introduction of shell side fluid and a second nozzle near the second end for the withdrawal of shell side fluid and annular distributors for said first nozzle and said second nozzle, a third nozzle for the introduction of tube side fluid and a fourth nozzle for the withdrawal of tube side fluid, the improvement is provided comprising means for adjusting the shell side nozzle and shell ports flow areas, so that the flow area ratios of nozzle to annulus and annulus to shell ports can be optimized and pressure drop across the annular distributors of the shell side can be minimized. According to another aspect of the invention, by employing variable area nozzle liners and adjustable area shell inserts, the annular distributor pressure recovery can be adjusted after fabrication of the heat exchanger to achieve design goals of minimum pressure drop across the shell side. In still another aspect of this invention, the optimal annulus-to-nozzle flow area ratio can be achieved by using nozzle liners of varied wall thicknesses, which alter the nozzle flow area. In a still further aspect of this invention, the shell ports-to-annulus flow area ratio can be varied to achieve optimal performance by using variable-width shell inserts, which are fitted into recesses machined on the inside or outside diameter of the shell and thus at least partially block the shell port flow areas.

Still further, according to yet another aspect of this invention, a method is provided for reducing pressure drop across the shell side of a tube and shell heat exchanger fitted with annular distributors for the shell side inlet and outlet nozzles which comprises using the nozzle liners provided above and/or the variable-width shell inserts provided above to obtain the optimal flow area ratios of annulus-to-nozzle and shell ports-to-annulus.

In yet another aspect of this invention, a method is provided for controlling the circumferential and radial distribution of fluid passing from an inlet annular distributor into a heat exchanger shell by rotably and/or slidably adjusting a variable-width shell insert such that the shell port flow areas exposed are smallest near the nozzle and largest on the opposite side of the shell. The radial distribution of fluid entering the shell through the ports can thus be essentially uniform, providing optimum heat transfer with a tube bundle when installed in the shell.

This invention is applicable to shells suitable for use in shell and tube heat exchangers having only one annular distributor, and to exchangers having annular distributors at both inlet and exit ends. In the latter case, basic design criteria can require that the inlet and outlet annular distributors be of approximately equal size, or of different sizes. For example, where the heat exchanger serves as a condenser as well, the inlet annular distributor will generally be larger than the outlet annular distributor.

Although the invention is illustrated in the drawings using a "one-pass" shell, the invention can be applied to other shells of various shell-tube heat exchangers. (See Chemical Engineers' Handbook, Perry and Chilton, 5th Edition, McGraw Hill Book Company, New York, copyright 1973, pages 11-3 through 11-17.) Such other shell types include a two pass shell with divider plate, split flow, double split flow, and divided flow. Provided that annular distributors of appropriate size are provided according to normal design criteria, this invention for "fine-tuning" the flow area ratios for optimal performance is applicable to all heat exchangers with at least one annular distributor.

Figure 7A:
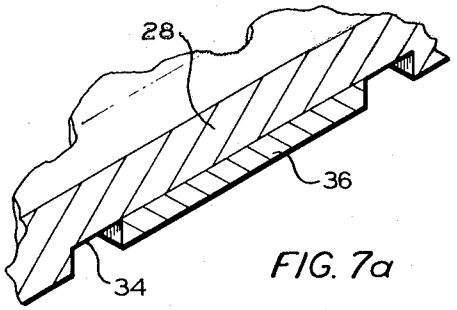
FIG. 7 is a cutaway isometric view of the annular distributor and shell shown in FIGS. 1 and 3.
Figure 7:
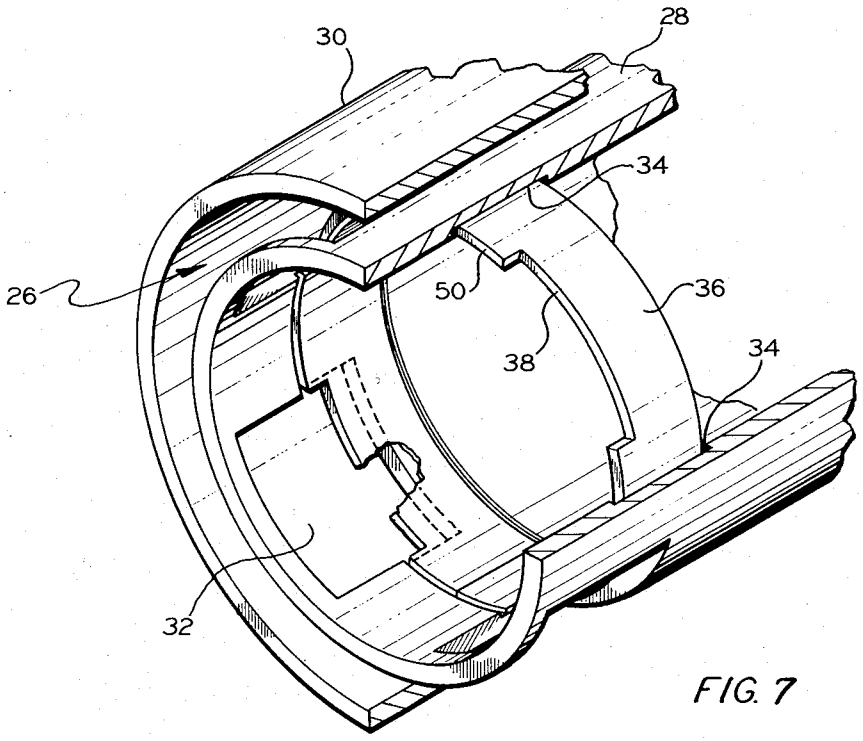

FIG. *7a* is an enlargement of a cross section of a portion of the apparatus shown in FIG. 7, illustrating the recess in the shell and the shell insert in the recess.

FIG. *7b* is a cutaway isometric view similar to FIG. 7 showing the shell insert fitted in a recess on the outer surface of the shell rather than the inner surface.

Figure 1:
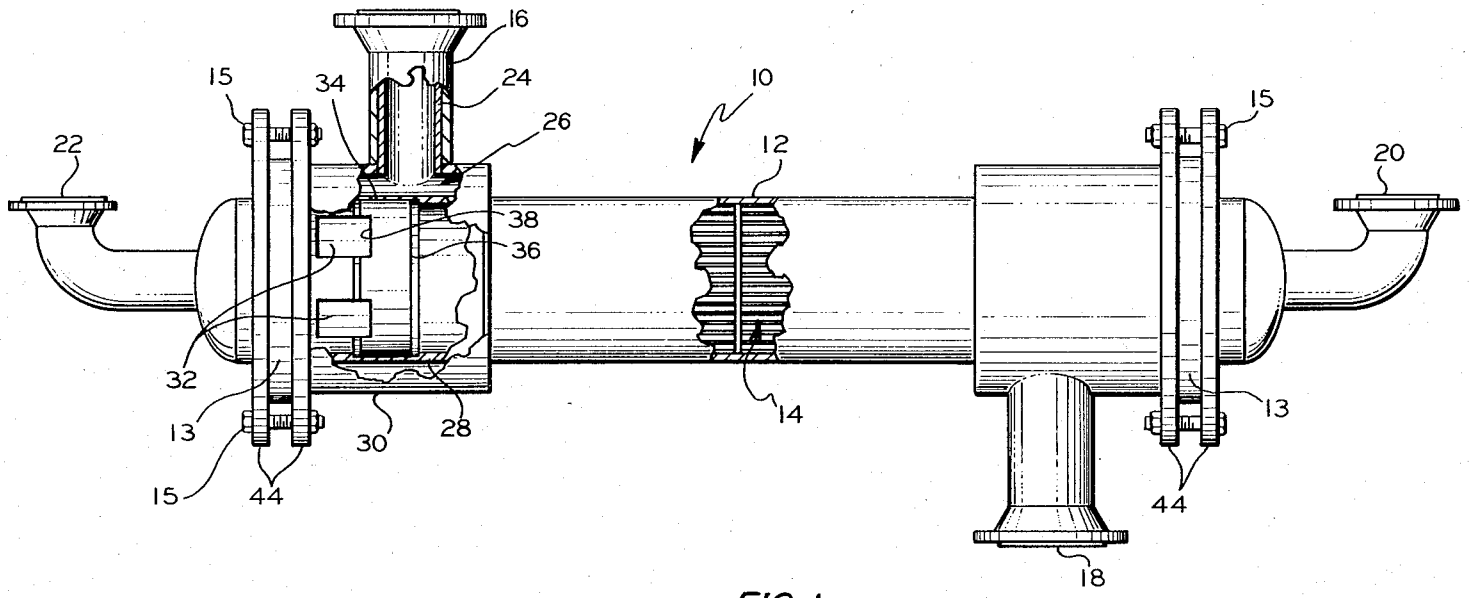
FIG. 1 is an elevational view of a shell and tube heat exchanger with annular distributors fitted, which is taken in cross section and illustrates certain features of the present invention.
Figure 3:
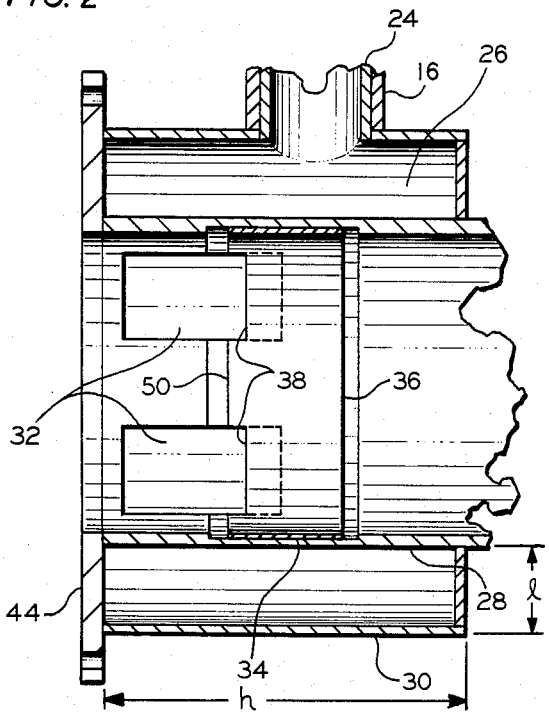
FIG. 3 is a cutaway view of the annular distributor and a portion of the shell of the shell and tube heat exchanger shown in FIG. 1.
Figure 8:
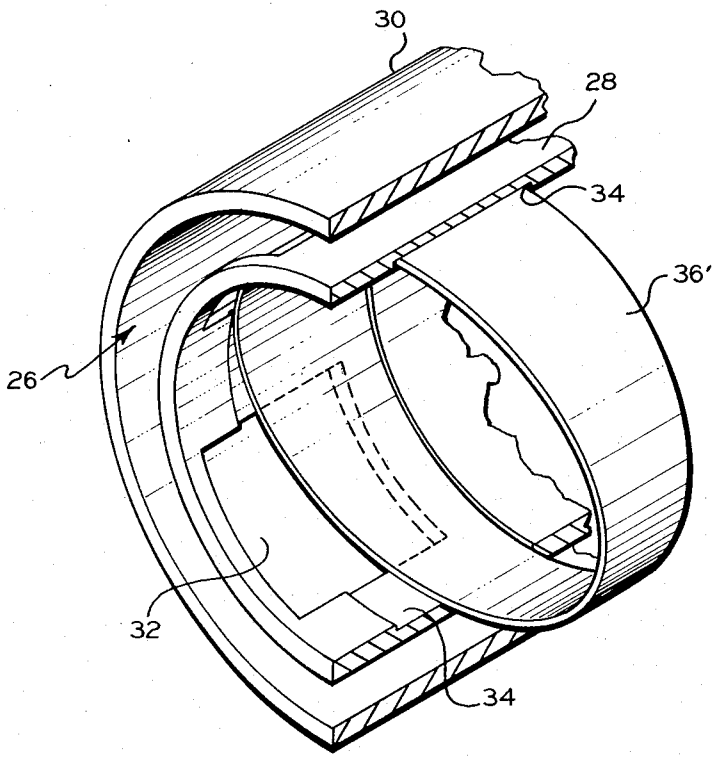

FIG. 8 is a cutaway isometric view of a portion of the annular distributor and shell shown in FIGS. 1, 3 and 7, illustrating a modified variable width shell insert.

Figure 9:
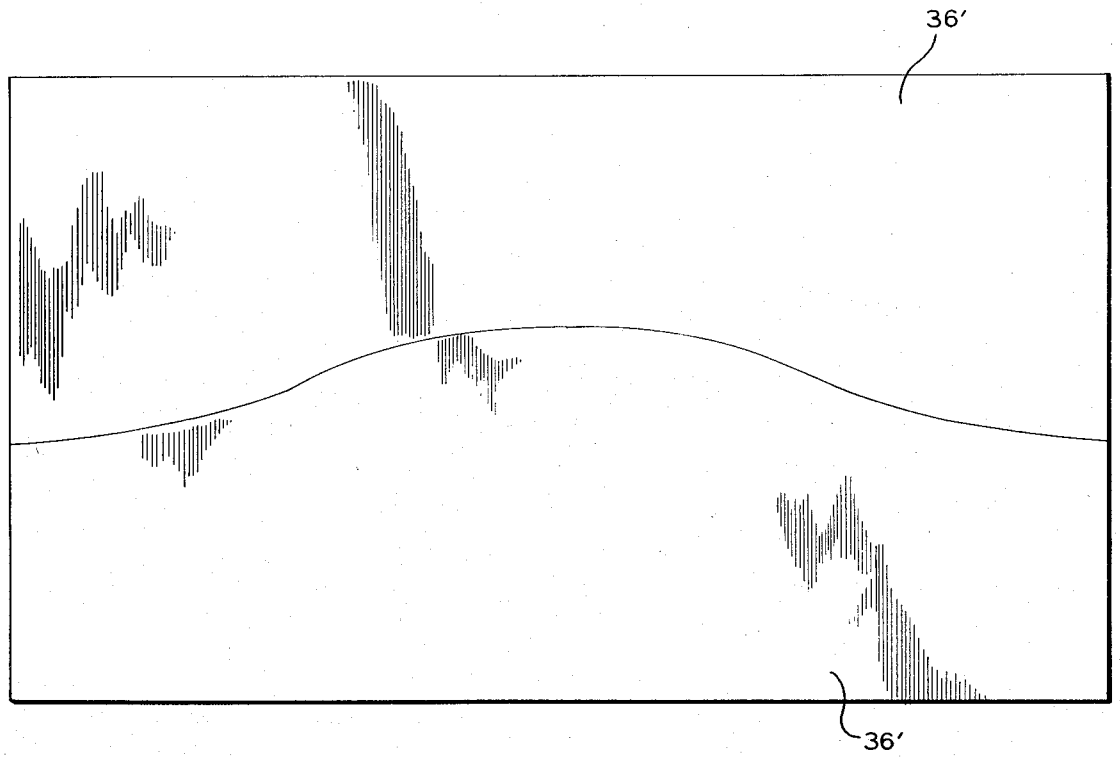

FIG. 9 is an elevation view of a pattern for cutting two of the modified shell inserts, as shown in FIG. 8, from a rectangular piece of sheet metal.

Figure 10:
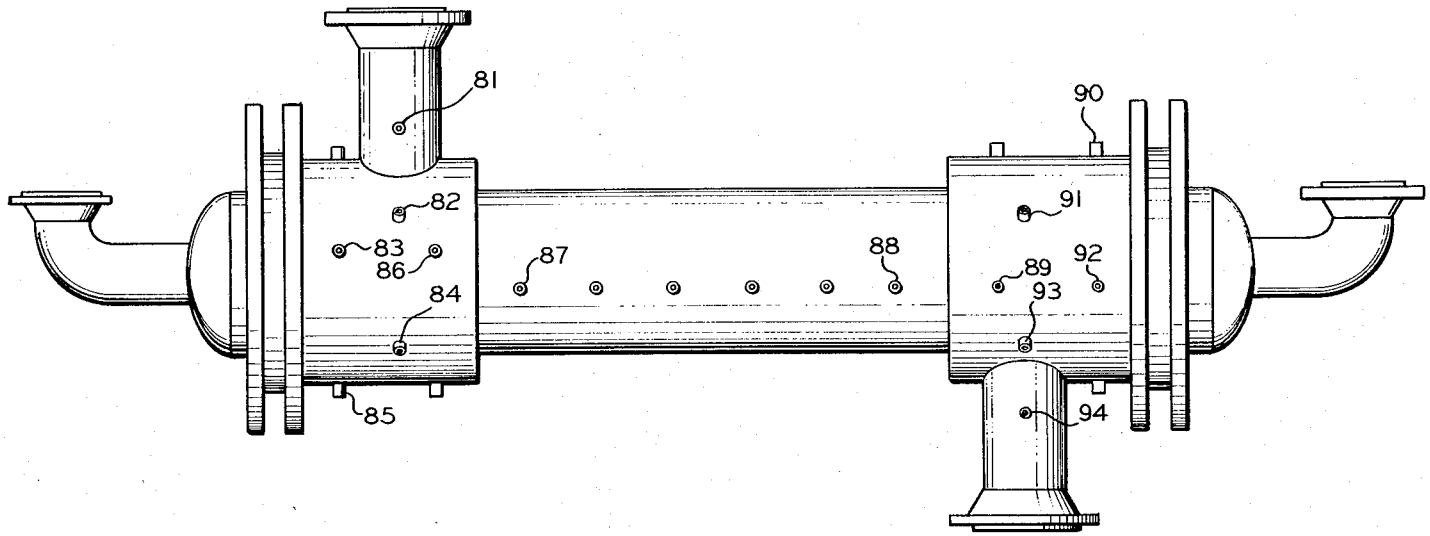

FIG. 10 illustrates apparatus used for measuring differential pressures in the shell and tube heat exchanger of FIG. 1.

Figure 11:
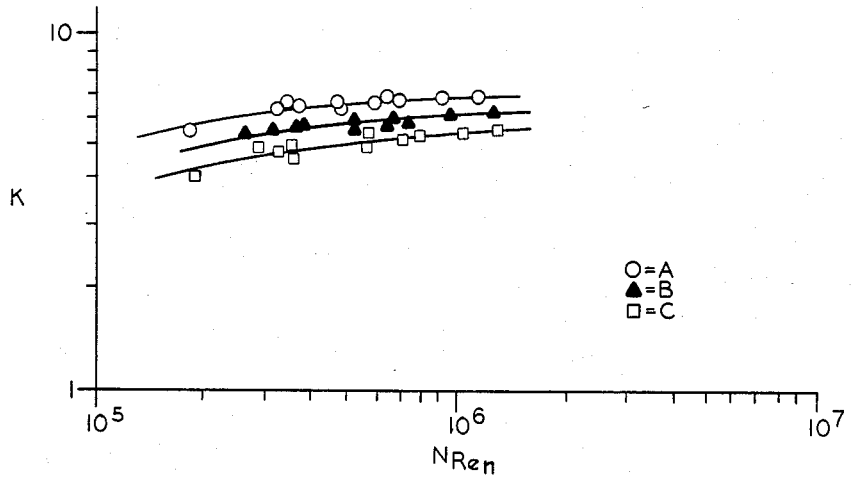

FIG. 11 shows plots of the resistance coefficient K versus Reynolds Number to illustrate the present invention.

Figure 12:
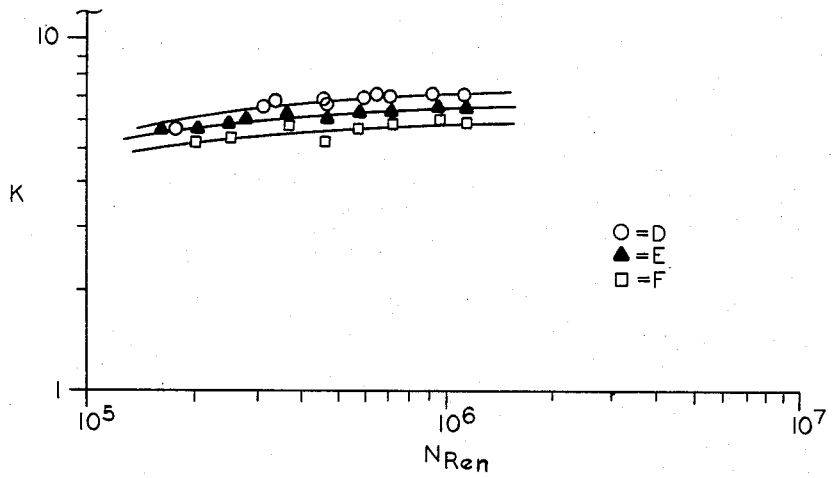

FIG. 12 shows plots of the resistance coefficient K versus Reynolds Number to illustrate the present invention.

DETAILED DESCRIPTION OF THE INVENTION

Shell and tube heat exchangers fitted with annular distributors are preferably designed to minimize pressure drop across the shell side. The total pressure drop can be conveniently divided into the pressure drops in the inlet and outlet annular distributors, respectively, and the pressure drop inside the shell. A certain amount of pressure drop across the tube bundle is required to achieve the desired heat transfer, but conventional plate-baffle heat exchangers exhibit a relatively high pressure drop relative to the amount of heat transferred.

Improved heat exchangers, licensed by Phillips Petroleum Company as RODBaffle® exchangers, have been developed; see, e.g., U.S. Pat. No. 3,708,142, Jan. 2, 1973. Such heat exchangers have a relatively high rate of heat transfer compared with pressure drop. In applications, such as RODBaffle® exchangers, where there is relatively little pressure drop inside the shell, e.g., where the pressure drop inside the shell is approximately equal to the sum of the pressure drops in the inlet and outlet annular distributors, it is important to minimize the pressure drop through the annular distributors. That is, assuming that some maximum amount of pressure drop is allotted to a heat exchanger in a given installation, it is generally preferred to minimize the proportion of the pressure drop which takes place in the annular distributors so that a maximum proportion of the overall pressure drop can contribute productively to the heat transfer process inside the shell. When a heat exchanger is designed to maximize the ratio of heat transferred to total pressure drop, as with the RODBaffle® designs, this is particularly desirable. Thus while the present invention is applicable for shells of shell and tube heat exchangers generally, it is particularly applicable to shells of RODBaffle® heat exchangers.

For conventional liquid-to-liquid flows, it has been discovered that heat exchangers are preferably designed and constructed with annular distributors at both inlet and outlet sides of the shell and with the fluid flow area progressively "opening up" as the fluid passes through, at least in the inlet and outlet annular distributors. That is, the ratios of shell inlet flow areas mentioned earlier are greater than 1.0, such that the inlet annulus flow area exceeds the inlet nozzle flow area, and the inlet shell port flow area exceeds the corresponding annulus flow area. Furthermore, the outlet shell port flow area should generally be greater than the shell inlet port flow area, with the shell outlet annulus flow area larger than the shell outlet port area, and the outlet nozzle area larger than the outlet annulus area, so that the outlet flow area ratios of ports to annulus and annulus to nozzle are less than 1.0. To achieve the design criterion described above, it may be necessary to connect the inlet and/or outlet nozzles of a heat exchanger with inlet/outlet lines slightly larger or smaller (e.g., within 20%) than the nozzles. Alternatively, if economic or technical factors require that the nozzles and/or lines be of the same size, the criterion can be applied to the annular distributors separately, with, e.g., the shell ports for the outlet being smaller than those for the inlet.

However, many exceptions to this design criterion exist, particularly where a single annular distributor is employed, or where annular distributors of different sizes are required to accommodate vapor as well as liquid flow. In such cases, it is still preferred that the flow areas increase as a fluid passes through the inlet or outlet end systems of nozzle/annulus/shell ports, except where a vapor is condensed into a liquid.

According to this invention, means comprising nozzle liners and shell inserts are provided for adjusting the flow areas of nozzles and shell ports in the annular distributors of such shells, thus facilitating the optimization of the relevant flow area ratios and minimizing shell side pressure drop, particularly the pressure drops in these annular distributors. Heat exchangers can thus be "fine-tuned" for minimum shell side pressure drop upon installation, or when subsequently opened for overhaul, repair or inspection. Generally, removal of the tube bundle will be required for such fine-tuning. If sufficient capacity for adjustment is provided according to this invention, the flow of shell side fluid through such a heat exchanger could even be reversed without adversely affecting efficiency of operation, as illustrated in Example III. In an embodiment, the shell port inserts of this invention can be adjusted in an inlet annular distributor to control the circumferential and radial distribution of fluid passing from said distributor through the shell ports, thus, e.g., providing an essentially uniform distribution of fluid throughout the shell.

The following detailed description is directed to an embodiment of the invention as shown in the drawings, with emphasis on the inlet side of the heat exchanger. The same features and criteria generally apply to the outlet side of a heat exchanger, particularly to the type which preferably has an outlet annular distributor similar to the inlet annular distributor. Although the embodiment described has the inlet and outlet, with their respective annular distributors, at opposite ends of the heat exchanger shell, the invention is of course applicable to other designs, e.g., multiple-pass heat exchangers having the inlet and outlet at the same end of the shell, or even designs with multiple inlets and/or outlets for the shell. However, due to direction of flow, the ratios to be optimized are not identical. For an inlet annular distributor the ratios considered are annulus-to-nozzle and shell ports-to-annulus, while with an outlet annular distributor the ratios considered are annulus-to-shell ports and nozzle-to-annulus.

FIG. 1 depicts a shell-tube heat exchanger 10 comprising shell 12 and tube-bundle 14. The tubes 14 are affixed to tube sheets 13 which are held by flanges 44 bolted at 15. Shell-side fluid enters exchanger 10 via inlet nozzle 16 and shell side fluid exits exchanger 10 via outlet nozzle 18. To avoid excessive pressure drop, the inlet nozzle should generally be at least as large as the pipe entering it, and the outlet nozzle should be approximately the same size as the pipe it feeds to. Tube-side fluid enters the tubes via inlet conduit 20 and tube-side fluid exits the tubes via outlet conduit 22 for counter-current flow. Liner 24 can be mounted within nozzle 16 to decrease the cross-sectional flow area of the shell side fluid charged into exchanger 10. Shell fluid annulus 26 is formed by inner cylindrical means 28, which can be an extension of shell means 12, and outer cylindrical means 30, the annulus 26 being a flow port for shell inlet fluid. Outer cylindrical means 30 form the annular distributor earlier referred to, which distributes fluid from the nozzle to the shell interior. Inner cylindrical means 28 has four shell ports 32 therein allowing the passage therethrough of fluid from annulus 26 into the shell side of exchanger 10, wherein indirect heat exchange of the fluid in the shell with fluid in the tubes of tube bundle 14 is effected. Materials of construction for such shells and tube bundles can, in general, be chosen from those available in commerce, taking into account the corrosive nature of materials entering the shell and tubes as well as the expected pressures of operation. The inner periphery of inner cylindrical means 28 has a recess 34, to retain slideably and/or rotably positioned cylindrical shell insert 36, preferably having four openings 38 therein, so that the four ports 32 can be at least partially closed. The cylindrical inserts are preferably installed in recess 34 in such a way that they can be adjusted by rotation as well as sliding. The four openings 38 therein are designed to facilitate the adjustment of the port flow areas for both pressure loss and axial flow distribution enhancement of fluid near the tube sheet. Said openings can be on one or more edge of such inserts, and/or in the central portion of the inserts, and can be of various shapes, comprising rectangular, rounded, triangular and the like.

Figure 2:
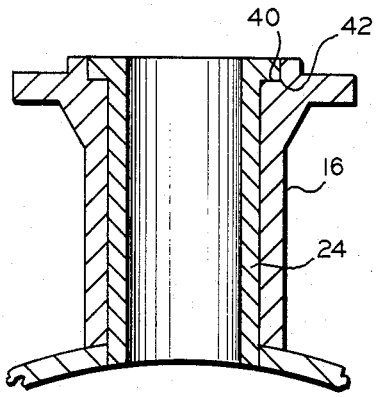
FIG. 2 is an elevational view of the nozzle affixed to the annular distributor of the heat exchanger shell shown in FIG. 1.

FIG. 2 details the nozzle 16 with liner 24 therein. Shoulder 40 of liner 24 fits against receiving recessed means 42 of nozzle 16. Liner 24 can be provided with various wall thicknesses, to provide any nozzle flow area desired which is less than the original nozzle area. Nozzle liner 16 and shell insert 36 (FIG. 1) are preferably made of metals similar to those which they contact in the heat exchanger, thus avoiding the adverse electrolytic effects of adjacent dissimilar metals and being compatible with the fluids passing through the shell side. However, nozzle liner 16 can be made of other compositions of matter compatible with the shell-side fluid and resistant to friction, comprising plastics, ceramics and glasses. The nozzle flow area NA is defined as simply the cross-sectional area of the nozzle inside diameter, which can be altered by the use of the nozzle liners of this invention.

FIG. 3 is a detailed showing of inlet nozzle 16, liner 24, annulus 26, inner cylindrical means 28, outer cylindrical means 30, shell ports 32 in inner cylindrical means 28, recess 34, insert 36, and openings 38 in insert 36. Numeral 44 indicates the flange attached to the shell to which (not shown) the tube sheet 13 of tube bundle 14 can be affixed. Tube sheet 13 can be attached to flange 44 by, e.g., bolts 15.

As fluid passes from the nozzle to the annulus, it can proceed in two directions into the annulus. Thus, the efective annulus flow area AA, the area through which fluid flows, is twice the longitudinal cross-sectional area of the annular port. Expressed as a formula, $$AA = 2hl,$$

where AA is the effective annulus area, h is the radial height of the annular port, i.e., the distance between the annular wall and the shell and l is the length of the annulus along the longitudinal surface of the heat exchanger shell, as seen best in FIG. 3.

Figure 4:
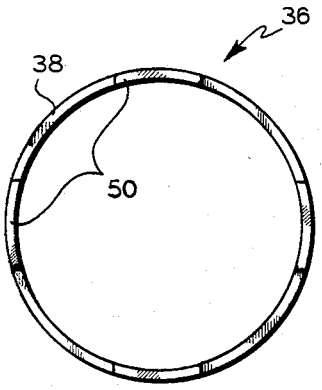
FIG. 4 is a front view of the variable width shell insert shown in FIGS. 1 and 3.

FIG. 4 is a cross-sectional view of insert 36 having the openings 38 therein.

Cylindrical insert 36 is preferably installed in a recess 34 in the inner surface of the shell, the inner cylinder 28. For this embodiment, it is desirable that the insert metal be tempered, worked or heat treated so that it is springy, allowing said insert to be installed so that it is held in position at least partially by expansive tension. The insert is preferably also fastened in place after adjustment by any appropriate mechanical means, comprising set screws, pins, shim rings, welding and the like. Cylindrical inserts can also be cut to fit snugly in the recess provided in the shell, with the openings in the inserts exposing the desired areas of the shell ports. The inserts are thus more simply and securely installed, but cannot be further adjusted by sliding longitudinally.

Figure 7B:
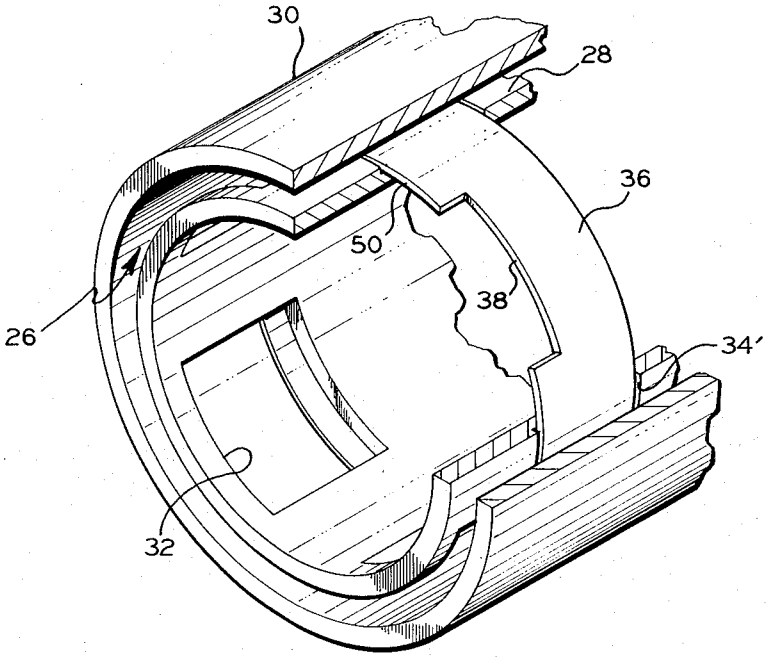

Cylindrical insert means can alternately be installed in a recess 34' cut into the outer surface of the shell (inner cylinder 28), as shown in FIG. 7*b*, in which case the metal of said insert means is preferably malleable rather than springy, and the inserts are preferably fastened securely in place after adjustment. This embodiment offers the advantage that the insert means can be made accessible through the open nozzle means if necessary for simplified adjustment.

Again referring to FIG. 3, it will be seen that in installing insert 36 in recess 34, the shell ports 32 will be covered to a greater or lesser degree, depending upon where said insert 36 is positioned by sliding and/or rotation. The effective shell ports flow area PA, defined as the total ports area uncovered or exposed, can thus be limited to any figure less than the total area of the ports before the insert is fastened in place.

Although for minimum annular pressure drop heat exchangers are designed so that the flow path areas progressively increase along the annular flow paths, by using combinations of the nozzle liners and shell inserts of this invention in at least the outlet side, it is possible to adjust a heat exchanger such as the embodiment depicted here for reversed flow through the shell side, as illustrated in calculated Example III. This can be advantageous in certain instances, e.g. where a heat exchanger can be physically installed more easily in one position than in another or where it becomes necessary to redirect the flow of shell-side fluid through a heat exchanger permanently installed in an existing system.

Figure 5:
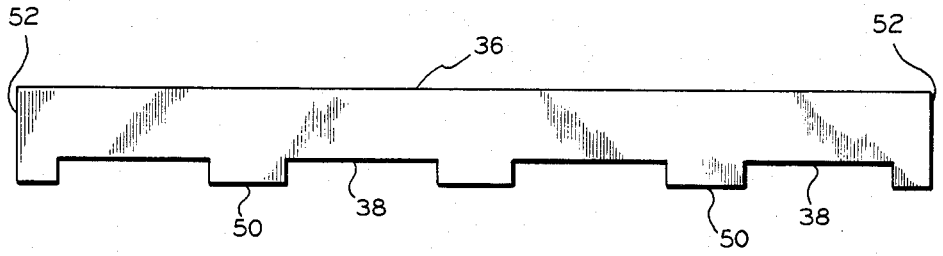
FIG. 5 is an elevational view of the variable width shell insert of this invention shown in FIGS. 1, 3 and 4, in flat form, before being bent into cylindrical form for insertion into the shell of the heat exchanger.

FIG. 5 shows insert 36 prior to being formed into a cylindrical configuration. In this figure the insert is flat, illustrating how insert means 36 can be cut from materials such as a sheet of metal.

Figure 6:
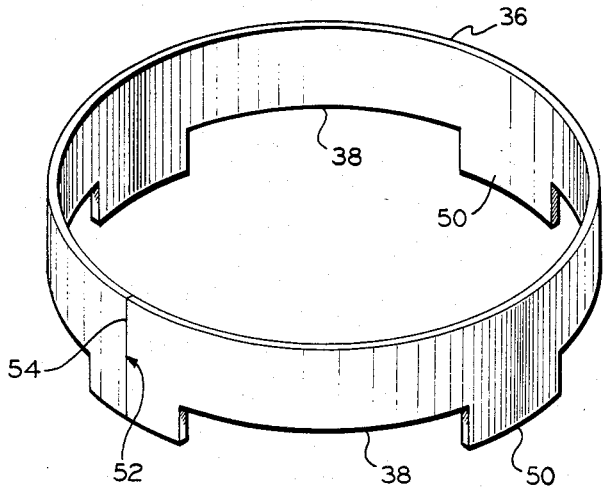
FIG. 6 is a view of the variable width shell insert of this invention as inserted into the shell of the heat exchanger shown in FIGS. 1 and 3.

FIG. 6 is a view of the closed cylindrical insert 36 with openings 38 and extension means 50. Ends 52 and 54 form the closure of ends of insert 36.

By preferably providing openings 38 in insert 36, the effective area of shell ports 32 can be closely adjusted by sliding and/or rotating the insert within recess 34. The openings can be in various shapes, placed on the edge or in the interior of the insert, designed to provide appropriate adjustments of the effective port flow area as the insert is slid or rotated. Such inserts can also be provided without such openings, i.e., as a strip of uniform or varied width, and will be operable to control the effective port flow area by sliding, especially if a relatively longer recess is provided.

FIG. 7 is a cutaway view of the invention showing, in greater detail, portions of the apparatus including annulus 26, inner cylindrical means 28, outer cylindrical means 30, ports 32 in means 28, recess 34 in the inner periphery of means 28, insert 36, openings 38 in insert 36, and extension means 50.

FIG. 7*a* is a detail of FIG. 7 showing a portion of inner cylindrical means 28 with the recess means 34 which is retaining insert 36, and has sufficient longitudinal space for movement longitudinally of insert means 36.

FIG. 7*b* is a cutaway view of an embodiment of the invention in which the shell insert is fitted into a recess on the outer surface of the shell, i.e., within the annulus. Shell inserts fitted in this manner would normally be installed before the annular distributor is attached, and could not be replaced as easily as inserts fitted inside the shell, but offer the advantage that means can be provided for adjusting the insert slideably or rotably by access through the open nozzle, without the necessity of removing the tube bundle.

FIG. 8 is a cutaway isometric view of another embodiment of insert means 36 which is numbered 36'. Insert means 36' is movably retained in recess 34 of the inner cylindrical means 28, which means 28 has ports 32 therein. Insert 36' is a truncated hollow cylinder, as illustrated, with the truncated end facing the adjacent tube sheet (not shown). Insert 36' is movable both longitudinally and rotationally in recess 34, so that proper adjustment of shell fluid flow can be attained. Preferably, the truncated end is positioned to allow more shell fluid flow to the tube locus remote from the shell fluid inlet nozzle, allowing that portion of the tubes opposite the shell fluid inlet and adjacent to the tube sheet to receive proper contact with the shell fluid for optimum heat exchange. The truncated end angle with respect to the longitudinal axis is between about 20 and about 70 degrees, normally about 40 degrees. The truncated end can be formed by cutting a cylindrical insert blank or by laying out a pattern on a sheet of material, and cutting this, and then forming the truncated cylinder for insertion into recess 34 as insert means 36'.

FIG. 9 illustrates a flat plate of material with marking thereon for cutting to produce the sheet to be formed into the cylinder with the truncated end for use as insert means 36'. In the drawing one rectangular blank sheet can be used to produce two cut sheets to form two inserts 36'. The illustrated cut, as laid out by descriptive geometry, produces a cylindrical insert which appears to be cut by a plane passed through the cylinder. It is pointed out that a curved cut can be used on the truncated end of insert means 36'. That is, for simplicity of flow specifications, the markings on the sheet can be straight lines rather than the curved line illustrated.

Insert 36' can be adjusted not only to give the desired area ratios of the annulus flow area to port flow area, but also to radially direct the shell fluid flow as desired for proper contact of shell fluid with the tubes remote from the shell fluid inlet nozzle.

The insert 36' can similarly be used at the outlet end of the shell-tube heat exchanger, to ensure that all tubes at that end receive full contact with the fluid before the fluid passes from the shell into the annulus.

FIG. 10 shows a test heat exchanger with pressure taps for determining various pressure differentials between the various pressure taps.

The following examples illustrate further details and embodiments of this invention but are not intended to unduly limit the scope thereof.

EXAMPLE I

To test for the effects of the relationships of the nozzle cross-sectional area, the annulus area, and the shell entry area on pressure drops across portions of the shell-tube heat exchanger, the following listed pressure points shown in FIG. 10 were used:

81. Within inlet nozzle;
82. Within inlet annulus at 45 degrees circumferentially from inlet nozzle;
83. Shell side of exchanger at inlet end at about 90 degrees circumferentially from inlet nozzle;
84. Within the inlet annulus at 135 degrees circumferentially from inlet nozzle;
85. Shell side of exchanger at about 180 degrees circumferentially from inlet nozzle;
86. Shell side of exchanger at about 90 degrees circumferentially from inlet nozzle;
87. Shell side of exchanger downstream from inlet annulus at about 90 degrees circumferentially from inlet nozzle;
88. Shell side of exchanger upstream from outlet annulus at about 90 degrees circumferentially from outlet nozzle;
89. Shell side of exchanger at about 90 degrees circumferentially from outlet nozzle;
90. Shell side of exchanger at about 180 degrees circumferentially from outlet nozzle.
91. Within the outlet annulus at 135 degrees circumferentially from outlet nozzle;
92. Shell side of exchanger at about 90 degrees circumferentially from outlet nozzle;
93. Within outlet annulus at 45 degrees circumferentially from outlet nozzle; and
94. Within outlet nozzle.

Various tests were made using different constant shell fluid flows, constant tube fluid flows, constant shell fluid inlet pressure and temperature, constant tube fluid inlet pressure and temperature, but at various ratios of nozzle radial cross-sectional areas to effective annulus areas, and of effective annulus areas to shell-ports' flow areas. Pressures were measured at different points (see above) and differential pressures were determined (correcting for pressure drops caused by tube bundle in the measured loci) to determine the effects of ratio changes on heat exchange efficiency.

In one set of data, the shell fluid was water at about 50° F. No tube side fluid was used in this isothermal operation.

The inlet nozzle cross-sectional area (NA) was 0.1278 square feet; the annulus flow area (AA), as defined herein, was 0.1409 square feet, and the inlet shell ports flow area (PA) was 0.1622 square feet. The ratios, as reported, were:

NA/AA=0.907
AA/NA=1.10
PA/AA=1.15

Results are summarized in Table I, below.

TABLE I

| Run No. | Flow Rate(1) (lbs/hr) | Vn(2) (ft/sec) | $\rho Vn^2$(3) (lb/ft-sec$^2$) | Va(4) (ft/sec) | Vp(5) (ft/sec) | $NRe_n$(6) | ΔP(7) | K(8) |
|---|---|---|---|---|---|---|---|---|
| 1 | 94,144 | 3.281 | 672 | 2.976 | 2.585 | 94,209 | 0.120 | 1.66 |
| 2 | 127,300 | 4.442 | 1231 | 4.029 | 3.500 | 156,113 | 0.536 | 4.05 |
| 3 | 179,686 | 6.271 | 2454 | 5.688 | 4.941 | 227,754 | 1.342 | 5.08 |
| 4 | 145,600 | 5.083 | 1612 | 4.610 | 4.005 | 191,237 | 0.796 | 4.59 |
| 5 | 173,923 | 6.072 | 2301 | 5.507 | 4.784 | 228,761 | 1.232 | 4.98 |
| 6 | 219,840 | 7.674 | 3675 | 6.961 | 6.047 | 287,113 | 2.161 | 5.46 |
| 7 | 248,046 | 8.641 | 4659 | 7.838 | 6.809 | 233,935 | 2.772 | 5.52 |
| 8 | 248,124 | 8.643 | 4661 | 7.840 | 6.810 | 227,841 | 2.881 | 5.73 |
| 9 | 330,362 | 11.510 | 8267 | 10.440 | 9.069 | 315,287 | 5.221 | 5.86 |
| 10 | 408,501 | 14.236 | 12646 | 12.912 | 11.217 | 411,818 | 7.994 | 5.87 |

(1)Flow rate is pounds of water per hour;
(2)Vn is velocity of water in nozzle, feet per second;
(3)$\rho Vn^2$ is pounds/cu. ft times nozzle velocity squared; $\rho$ is actual pounds per cubic foot of water density;
(4)Va is velocity of water in annulus, feet per second;
(5)Vp is velocity of water through inlet ports;
(6)$NRe_n$ is $\frac{\rho\ Dn\ Vn}{\mu n}$, calculated for the inlet nozzle,
where
Dn is nozzle diameter in feet;
$\mu n$ is actual viscosity of water;
$\rho$ is defined above; and
Vn is defined above.
(7)ΔP is differential pressure, psi, $P_{81}-P_{86}-M$
where M is ΔP (psi) caused by tube bundle of segment from taps 81 to 86, which can be either measured or estimated as a proportion of the ΔP for the total length of the tube bundle; and
(8)$K = \frac{\Delta P \times 2g_c}{\rho Vn^2}$ ($g_c$ = gravity constant)

A specimen calculation for run 1 follows:

94,144 lbs/hr÷3600=26.1511 lbs/sec
$\rho \approx 62.4$ lbs/gal (water)
26.1511 lbs/sec÷62.4 lbs/cu ft=0.4191 ft$^3$/sec; NA=0.1278 ft$^2$
Vn=0.4191 ft$^3$/sec÷0.1278 ft$^2$=3.2792 ft/sec
$Vn^2$=10.7538 ft$^2$/sec$^2$
$\rho Vn^2$=62.4 lbs/ft$^3$×10.7538 ft$^2$/sec$^2$=671 lbs/ft/sec$^2$
$\mu$=0.00088 lbs/ft/sec (viscosity)
$(\pi Dn^2)/4$=0.1278 ft$^2$; Dn=0.4034 ft
$NRe_{(n)}$ (Nozzle Reynolds Number)=$(\rho n\ Dn\ Vn)/\mu n$ $$NRe_{(n)} = \frac{62.4\ \text{lbs/ft}^3 \times 0.4034\ \text{ft} \times 3.2792\ \text{ft/sec}}{0.00088\ \text{lbs/ft/sec}} = 93{,}800 \text{ (dimensionless)}$$

$$K = \frac{\Delta P \times 2\ gc}{\rho \cdot Vn^2} \qquad \Delta P = 0.12\ \text{psi} \qquad \Delta P = 17.28\ \text{lbs/ft}^2$$

-continued $$K = \frac{17.28\ \text{lbs/ft}^2 \times 2 \times 32.2\ \text{ft/sec}^2}{62.4\ \text{lbs/ft}^3 \times 10.7538\ \text{ft}^2/\text{sec}^2} = 1.66\ \text{dimensionless}$$

Although $\rho$ changes with temperature and pressure, it can be seen that K is a function of $\Delta P/Vn^2$.

Referring again to my K value, or resistance coefficient, reference is had to "Flow of Fluids Through Valves, Fittings, and Pipes", Trane Technical Paper No. 410, 1957, pages 2–8 and A-26, with equation 2—2 as rearranged.

Equation 2—2 shows $$h_L = (KV^2/2gc)\ \text{(in feet)}.$$

By multiplying both sides by $\rho$(lbs/ft3), the dimensions become pressure, (lbs/ft$^2$):

$$h_L \cdot \rho = \Delta P = (Kv^2\rho/2gc)\ (\text{lbs/ft}^2)$$

solving for K (dimensionless), $$K = \Delta P 2gc/\rho V^2.$$

The resistance coefficient should thus be minimized to obtain the minimum pressure drop across, e.g., the annular distributor, at least to the extent permitted by other factors.

Using the same apparatus that was used for the data in Table I, but using cooling water flow in the tubes (inlet temperature about 100° F.) and using heated water flow in the shell (inlet temperature about 150° F.), the results of this operation are summarized in Table II, below.

TABLE II

| Run No. | Flow Rate (lbs/hr) | Vn (ft/sec) | $\rho Vn^2$ (lb/ft-sec$^2$ | Va (ft/sec) | Vp (ft/sec) | $NRe_n$ | ΔP | K |
|---|---|---|---|---|---|---|---|---|
| 11 | 92,407 | 3.283 | 673 | 2.978 | 2.587 | 274,437 | 0.140 | 1.97 |
| 12 | 135,726 | 4.824 | 1452 | 4.376 | 3.801 | 406,724 | 0.670 | 4.37 |
| 13 | 173,097 | 6.159 | 2367 | 5.586 | 4.852 | 528,025 | 1.224 | 4.9 |
| 14 | 213,815 | 3604 | 6.893 | 5.988 | 641,450 | 2.114 | 5.55 | |
| 15 | 244,121 | 8.661 | 4681 | 7.856 | 6.824 | 707,739 | 2.836 | 5.72 |
| 16 | 340,896 | 12.092 | 9124 | 10.968 | 9.528 | 984,246 | 5.716 | 5.92 |
| 17 | 418,830 | 14.867 | 13792 | 13.484 | 11.714 | 1,224,857 | 8.914 | 6.11 |
| 18 | 249,887 | 8.880 | 4921 | 8.054 | 6.997 | 745,894 | 2.979 | 5.73 |
| 19 | 337,543 | 11.997 | 8981 | 10.882 | 9.453 | 1,010,942 | 5.717 | 6.02 |
| 20 | 416,065 | 14.790 | 13650 | 13.415 | 11.653 | 1,248,884 | 8.857 | 6.14 |

These data illustrate that as the flow velocity Vn and Reynolds Number $NRe_n$ are increased, the pressure differential and resistance coefficient K increase. However, for a given range of Reynolds Numbers (which is dependent upon flow velocities), it has been found that generally lower K values, and thus lower ΔP, will be obtained when the values of the flow area ratios AA/NA and PA/AA are at least 1.0 for an inlet annular distributor. Calculations and tests should be performed separately for the outlet annular distributor, particularly when fluid is flowing in the tubes, due to density and viscosity effects.

EXAMPLE II

Using the method of Example I, test runs and calculations were performed on the inlet annular distributor system to study the effects of independently varying the ratios of annulus flow area to nozzle cross-sectional area and shell ports flow area to annulus flow area. Data for runs with the flow area ratio AA/NA (annulus area/-nozzle area) adjusted to three values are presented in Table III. For each run, the values of the resistance coefficient K are tabulated for various Reynolds numbers for the nozzle. The flow area ratio PA/AA was held constant at 1.033 for all runs.

TABLE III

| CURVE A AA/NA = 1.017 | | CURVE B AA/NA = 1.2 | | CURVE C AA/NA = 1.3 | |
|---|---|---|---|---|---|
| $NRe_n$ | K | $NRe_n$ | K | $NRe_n$ | K |
| 324,928 | 6.20 | 387,149 | 5.92 | 192,786 | 3.96 |
| 349,873 | 6.62 | 305,208 | 5.75 | 282,783 | 4.89 |
| 186,230 | 5.46 | 254,212 | 5.52 | 335,054 | 4.99 |
| 386,219 | 6.57 | 750,844 | 5.86 | 365,077 | 5.06 |
| 488,100 | 6.50 | 998,442 | 6.11 | 558,153 | 5.32 |
| 650,865 | 6.77 | 1,286,157 | 6.34 | 510,039 | 5.42 |
| 494,315 | 6.15 | 541,520 | 5.36 | 554,976 | 4.80 |
| 609,708 | 6.64 | 645,492 | 5.64 | 705,597 | 5.15 |
| 714,917 | 6.75 | 677.727 | 6.16 | 771,758 | 5.31 |
| 942,000 | 6.66 | | | 1,093,548 | 5.42 |
| 1,184,163 | 6.91 | | | 1,317,485 | 5.60 |

The data of Table III are plotted in FIG. 11 as curves A, B and C. For the ranges of Reynolds Numbers covering the test runs, a family of flat curves results, with the values of resistance coefficient K decreasing as the inlet area ratio AA/NA is increased.

Using the same methods and holding the flow area ratio AA/NA constant at 1.02, runs and calculations were performed for three values of the inlet flow area ratio PA/AA. The data are tabulated in Table IV below and plotted in FIG. 12 as curves D, E and F.

TABLE IV

| CURVE D PA/AA = 1.033 | | CURVE E PA/AA = 1.15 | | CURVE F PA/AA = 1.263 | |
|---|---|---|---|---|---|
| $NRe_n$ | K | $NRe_n$ | K | $NRe_n$ | K |
| 324,928 | 6.20 | 280,747 | 6.00 | 215,871 | 5.04 |
| 349,873 | 6.62 | 204,204 | 5.41 | 266,416 | 5.42 |
| 186,230 | 5.46 | 257,592 | 5.91 | 251,169 | 5.66 |
| 386,219 | 6.57 | 170,075 | 5.42 | 404,200 | 4.59 |
| 488,100 | 6.50 | 490,342 | 5.40 | 430,974 | 5.96 |
| 650,865 | 6.77 | 616,559 | 5.84 | 481,227 | 4.69 |
| 494,315 | 6.15 | 695,833 | 6.06 | 592,603 | 5.35 |
| 609,708 | 6.64 | 986,521 | 6.43 | 1,164,650 | 6.07 |
| 714,917 | 6.75 | 1,191,277 | 6.61 | 967,440 | 6.01 |
| 942,000 | 6.66 | | | 727,946 | 5.71 |
| 1,184,163 | 6.91 | | | | |

The curves of FIG. 12 illustrate that K decreases as the inlet ports-to-annulus area ratio PA/AA increases, as would be expected. However, the effect of increasing (PA/AA) appears to be less pronounced than increasing (AA/AN). Over the range of geometric conditions, i.e., (AA/NA) and (PA/AA), tested, no optimum or minimum K values were observed. In principle, the resistance coefficient K would continue to decrease as inlet flow area ratios (AA/NA) and (PA/AA) are increased. Thus the ideal or optimum configuration would be goverened by the cost of increasing the annular distributor geometry and the savings realized by lower pressure losses associated with reduced K values. Furthermore, if the areas of inlet nozzles or outlet ports were decreased excessively, frictional effects should predominate and negate the advantage of increasing the flow area ratios. Separate effects are presented in FIGS. 11 and 12, however it is expected that when both inlet flow area ratios (AA/NA) and (PA/AA) are increased simultaneously, the flow coefficient K would be reduced below the values obtained when only one variable is increased.

In practical applications, a shell can be fabricated with inlet ports cut to the maximum size practicable, consistent with the proposed size of the annular distributors, strength of materials, radial distribution of fluid flow, and the requirements for protection of the tube bundle from impingement at the inlet end. Once the size and flow area of the annular distributors are determined, the shell port inserts can be adjusted during fabrication and/or installation of the heat exchanger to produce an inlet flow area ratio PA/AA which is a maximum. Assuming the nozzle diameters have been designed to be comparable to those of the inlet and outlet lines, nozzle inserts can then be added, if necessary, to maximize the flow area ratio AA/NA. Based on the data presented in this Example, it is preferred, at least for the inlet, to maximize the ratio AA/NA rather than the ratio PA/AA, provided this can be done without constricting the nozzle excessively or creating too great a mismatch between the nozzles and inlet or outlet lines. For instance, the inlet nozzle should not be constricted by inserting liners too much smaller than about 80% of the flow area of the inlet line (i.e., not less than about 90% the diameter of the inlet line), and the outlet nozzle should not have a flow area greater than about 120% that of the outlet line. It is advantageous to accomplish final adjustments of the flow area ratios by inserting or removing nozzle liners, due to ease of access and the fact that a greater reduction in K values, thus pressure loss, is obtained by increasing the flow area ratio AA/NA than by increasing the ratio PA/AA.

While not wishing to be bound by any theory, it is believed that increasing the inlet flow are ratios AA/NA and/or PA/AA will continue to produce lower K values, but at a constant AA, NA must be decreased to produce an increase in AA/NA, and at too high a ratio, the nozzle velocity will become so high that frictional effects, turbulent flow, etc. begin to predominate and the assumptions implicit in the calculations herein may no longer apply. Similar effects are expected to apply for the flow area ratios of an outlet annular distributor, except that the corresponding ratios should be less than 1.0 to produce the desired effect of progressively "opening up" as fluid passes from inlet to outlet.

For practical operations, the ratio of inlet AA/NA will be in the range of from about 1.0 to about 3.0, preferably from about 1.1 to about 2.0; and more preferably from about 1.1 to about 1.5. In addition, at constant AA, inlet PA must be increased to produce an increase in inlet PA/AA, but PA is limited in size because too great a PA minimizes the desired distributing effect of the annulus itself. For practical operations, the ratio of inlet PA/AA will be in the range of about 1.0 to about 3; preferably about 1.1 to about 2; and more preferably about 1.1 to about 1.5.

Similarly, for an outlet annular distributor, the ratio of outlet AA/NA should be in the range of from about 0.3 to about 1.0, preferably from about 0.9 to about 0.5, and more preferably from about 0.9 to about 0.6. Likewise, the ratio of outlet PA/AA should be in the range of from about 0.3 to about 0.1, preferably from about 0.9 to about 0.5, and more preferably from about 0.9 to about 0.6. From reference to the drawings and formulas herein, it will be clear that, for fluid passin through the shell of the instant invention from inlet to outlet, the inlet flow area ratios AA/NA and PA/AA are preferably greater than 1.0, while the identical ratios AA/NA and PA/AA for the outlet must be less than 1.0, since the fluid passes from nozzle to ports at the inlet, then from ports to nozzle at the outlet. When arranged in the sequence encountered by the fluid as it transits the outlet annular distributor, the inverse flow area ratios AA/PA and NA/AA would be greater than 1.0.

EXAMPLE III

Calculated Example

As a practical example of a variable-area, annular distributor, without limiting the invention thereto, let us consider an application in which an annular distributor is required at both the inlet and exit ends of the shell and tube heat exchanger. For economic reasons, a minimal pressure loss is required for both annular distributors, which may require final field adjustment of the nozzle and shell slot areas after the exchanger is fabricated. (The shell ports take the form of rectangular slots in the shell. The nozzle area can be reduced by inserting nozzle liners as previously disclosed. The shell slot area, hereafter referred to as shell port area PA as previously disclosed, can be reduced by partially covering the slots with a shell insert, as previously disclosed.) Similarly, for economic reasons the same annular cylinder size and nozzle size are to be utilized for both inlet and exit distributors. Further, in this example process conditions dictate that the flow direction on the shell side of the annular distributor exchange may be periodically reversed, i.e., the inlet distributor becomes the exit distributor and vice versa. Under these periodically reversed-flow conditions, it is economically advantageous to adjust shell slot and nozzle dimensions in place, rather than disconnect process piping and physically move the exchanger such that the annular distributors are reversed. An annular distributor design for use at both inlet and exit ends which accomplishes the above objectives is illustrated as follows. With no nozzle liners or shell inserts, the basic annular distributor design provides an annulus-to-nozzle area ratio (AA/NA) of 0.83. Similarly, with no shell inserts present, a port-to-annulus area ratio (PA/AA) of 1.30 is produced.

These ratios can be changed by using nozzle liners of known flow area, and/or by positioning a shell insert to partially cover the ports, leaving uncovered the portions of the ports whose areas are calculated to produce the desired flow area. Where the shell ports take the form of rectangular slots as in this example, the positioning of the inserts to produce specific flow areas can be easily calculated. Such points can be determined and marked in fabrication or field installation for exchangers with various types of ports.

When the above described annular distributor is to be employed as the inlet distributor, where flow areas PA>AA>NA, a series of nozzle inserts producing area ratios (AA/NA) of 1.10, 1.15, and 1.20 are provided. The shell inserts can be positioned to produce slot-to-annulus area ratios (PA/AA) of 1.10, 1.15, and 1.20. Based on field operations, to achieve minimum pressure loss, it is envisioned that the optimum area ratios would be approximately AA/NA=1.15 and PA/AA=1.20. This inlet annular distributor configuration would require a relatively thickwalled nozzle insert and a relatively small shell insert width (i.e. portion of the slots which is covered) to achieve AA/NA=1.15 and PA/AA=1.20.

At the outlet annular distributor, where flow areas NA>AA>PA, the shell insert employed would be adjusted to cover more of the machined slot area, ultimately producing an area ratio of AA/PA=1.15. Since preferably NA>AA, the nozzle liner at the exit end would probably be omitted, producing an area ratio NA/AA=1.20. As with the inlet annular distributor, the precise shell insert setting and nozzle liner size would be established through field tests. At such time as the shell side flow is reversed, the liners and inserts employed in the original inlet distributor could be installed in the original exit distributor to achieve the desired increase in area with flow direction.

While this invention has been described in detail for the purpose of illustration, it is not to be construed as limited thereby, but is intended to cover all the changes and modifications within the spirit and scope thereof.

I claim:

1. A shell unit for use in a shell-and-tube heat exchanger, comprising:

a shell having at least one shell port;

at least one annular distributor attached to said shell, said annular distributor having an annulus which surrounds said shell such that fluid communication is provided between said shell port and said annulus;

at least one nozzle means in communication with the annulus of said annular distributor;

means for adjusting the fluid flow area of said at least one shell port.

2. Apparatus in accordance with claim 1, wherein said means for adjusting said flow area of said shell port comprises means for at least partially covering at least one of said ports.

3. A shell unit for use in a shell-and-tube heat exchanger, comprising:

a shell having at least one shell port;

at least one annular distributor attached to said shell, said annular distributor having an annulus which surrounds said shell such that fluid communication is provided between said shell port and said annulus;

at least one nozzle means in communication with the annulus of said annular distributor;

means for adjusting the fluid flow area of said at least one shell port, wherein said means for adjusting said flow area of said shell port comprises a flexible shell insert for at least partially covering at least one of said ports.

4. Apparatus in accordance with claim 3, wherein said flexible shell insert is a strip of springy metal.

5. Apparatus in accordance with claim 4, wherein said shell insert is bent in a cylindrical form and placed adjacent to said shell, such that said insert is contained in a recess cut into the wall of said shell such that said insert can be moved by sliding or rotating within said recess and thereby cover at least part of at least one of said ports.

6. Apparatus in accordance with claim 5, wherein at least a portion of said shell insert has openings therein to reduce the areas of said ports which are covered by said insert, and wherein the effective flow areas of said ports can be varied by sliding or rotating said insert inside said recess in said shell wall.

7. Apparatus in accordance with claim 5, wherein said shell insert is of varied width, such that rotation of said insert within said recess in said shell wall alters the radial distribution of fluid passing from said annulus through said ports into said shell.

8. Apparatus in accordance with claim 5, 6 or 7 wherein said shell insert is adjusted to a desired position and fastened to said shell wall by suitable mechanical means.

9. Apparatus in accordance with claim 5, wherein said shell insert can be adjusted so that the ports-to-annulus flow area ratio, PA/AA, is optimized so as to minimize shell fluid pressure drop.

10. Apparatus in accordance with claim 9, wherein said ports-to-annulus flow area ratio is at least 1.0 for an inlet side, and 1.0 or less for an outlet side.

11. Apparatus in accordance with claim 9 wherein said ratio PA/AA is in the range from about 1.0 to about 3.0 for the inlet side, and from about 0.3 to about 1.0 for the outlet side.

12. Apparatus in accordance with claim 9 wherein said ratio PA/AA can be in the range from about 1.1 to about 2.0 for the inlet side, and from about 0.5 to about 0.9 for the oulet side.

13. Apparatus in accordance with one of claims 3, 5, 6, 7, 9 or 10, further comprising a tube bundle enclosed within said shell.

14. Apparatus in accordance with claim 7, wherein said shell insert forms a truncated cylinder.

15. Apparatus in accordance with claim 14, wherein said cylinder has a truncated end angle of from about 20 to about 70 degrees.

16. A shell unit suitable for use in a shell-and-tube heat exchanger, comprising:

a cylindrical shell, closed at both ends and having an inner surface;

at least one cylindrical surface concentrically surrounding at least a portion of said shell, thus forming an annulus between said cylindrical shell and said at least one cylindrical surface, and having closing members at each end of said annulus;

nozzle means fitted to said cylindrical surface in communication with said annulus;

a plurality of ports through said cylindrical shell to provide communication between said annulus and said inner surface of said shell;

means for adjusting the fluid flow area of at least one shell port by partially covering at least one of said shell ports, wherein said means is a flexible shell insert.

17. A shell in accordance with claim 14, wherein said ratio of flow areas of said ports to said annulus can be adjusted to optimum values of at least 1.0 for an inlet annulus and 1.0 or less for an outlet annulus.

18. A shell in accordance with claim 16, wherein said flexible shell insert is a truncated cylinder rotatably adjustable to cover at least a portion of one or more of said ports so as to produce uniform radial distribution within said shell of a fluid when introduced through said nozzle means.

* * * * *